US006228205B1

(12) United States Patent
Rhodes et al.

(10) Patent No.: US 6,228,205 B1
(45) Date of Patent: May 8, 2001

(54) APPARATUS AND METHOD FOR FORMING A SPLICE IN ADVANCING WEB OF PAPER

(75) Inventors: David Earl Rhodes; Willis Augustus Usher, Jr., both of Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/206,350

(22) Filed: Dec. 7, 1998

(51) Int. Cl.[7] ..... B65H 21/00

(52) U.S. Cl. ..... 156/304.3; 156/504; 156/505; 156/507; 242/555.2; 242/556.1

(58) Field of Search ..... 156/304.1, 304.3, 156/502, 504, 505, 507; 242/553, 555.2, 556.1

(56) References Cited

U.S. PATENT DOCUMENTS

| | | | | |
|---|---|---|---|---|
| 2,500,273 | * | 3/1950 | Breth | 156/421 |
| 2,702,070 | * | 2/1955 | Lindemann | 156/502 |
| 3,556,912 | * | 1/1971 | Burgo et al. | 156/580.1 |
| 3,615,048 | | 10/1971 | Martin . | |
| 3,659,767 | | 5/1972 | Martin . | |
| 4,096,801 | | 6/1978 | Martin . | |
| 4,141,517 | | 2/1979 | Olcer . | |
| 4,143,829 | | 3/1979 | Martin . | |
| 4,153,218 | | 5/1979 | Martin . | |
| 4,519,858 | | 5/1985 | Martin . | |
| 4,563,324 | | 1/1986 | Kubo . | |
| 4,566,922 | | 1/1986 | Martinez . | |
| 4,629,531 | | 12/1986 | Kataoka . | |
| 4,769,098 | | 9/1988 | Cedarholm et al. . | |
| 4,801,342 | | 1/1989 | Wheeler et al. . | |
| 4,856,960 | | 8/1989 | Wheeler et al. . | |
| 4,859,270 | | 8/1989 | Martin et al. . | |
| 4,878,986 | | 11/1989 | Nishikawa . | |
| 4,880,178 | | 11/1989 | Goulette . | |
| 4,892,611 | | 1/1990 | Wheeler et al. . | |
| 4,915,282 | | 4/1990 | Martin et al. . | |
| 4,923,546 | | 5/1990 | Wheeler et al. . | |
| 5,009,749 | | 4/1991 | Cedarholm et al. . | |
| 5,064,488 | | 11/1991 | Dickey . | |
| 5,238,522 | | 8/1993 | Sakano et al. . | |
| 5,284,197 | | 2/1994 | Cedarholm et al. . | |
| 5,314,568 | | 5/1994 | Ryan . | |
| 5,335,870 | | 8/1994 | Martin . | |
| 5,337,969 | | 8/1994 | Martin . | |
| 5,360,502 | | 11/1994 | Andersson . | |
| 5,445,341 | | 8/1995 | Martin et al. . | |
| 5,468,321 | | 11/1995 | Van Liempt et al. . | |

FOREIGN PATENT DOCUMENTS

| | | |
|---|---|---|
| 195 33 112 A1 | 3/1997 | (DE) . |
| 0 554 947 A1 | 8/1993 | (EP) . |

* cited by examiner

*Primary Examiner*—Mark A. Osele
(74) *Attorney, Agent, or Firm*—Alston & Bird LLP

(57) ABSTRACT

An apparatus and method for forming a splice between the trailing end of an expiring web of paper or other material, and the leading end of a new web of material. The apparatus includes a clamp for engaging and stopping the advancing web, and a web severing mechanism to transversely move across and sever the stopped web. A new web holding assembly supports the leading end portion of the new web, and the holding assembly may be lowered to align the trailing and leading ends so that they may be joined by a tape or the like. The web severing mechanism includes a clamping wheel positioned to smooth the trailing end portion of the stopped web before it is severed by a following cutting wheel. Also, a hand-held tool is provided for accurately and safely positioning the leading end portion of the new web on the new web holding assembly.

16 Claims, 5 Drawing Sheets

APPARATUS AND METHOD FOR FORMING A SPLICE IN ADVANCING WEB OF PAPER

BACKGROUND OF THE INVENTION

The present invention relates to a web splicing apparatus and method for forming a splice between the trailing end of an advancing web of paper or other material and the leading end of a new web of material.

In the production of spirally wound composite containers and other similar products, a relatively narrow web of paper is fed at high speed from a supply roll to a tube winding machine. To permit the continuous operation of the tube winding machine upon the supply roll being emptied, the leading end of a web from a new supply roll must be secured to the trailing end of the expiring web. To facilitate this operation, a splicing machine has been previously proposed wherein the web advances through the splicing machine, and then through a festoon type accumulator, before proceeding to the tube winding machine. The leading end of the new web is fed into the machine by hand, and held in a ready position by a vacuum system, and as the supply roll is emptied, the trailing end of the expiring web is gripped and held stationary by the splicing machine. Then the leading end of a new web is moved into alignment with the trailing end of the expiring web and joined thereto by a piece of adhesive tape to form a butt splice. The advance of the joined web is then restarted, so that the new web is advanced through the festoon type accumulator and to the tube winding machine. The festoon type accumulator permits the web to be continuously supplied to the tube winding machine during the splicing operation, so that the tube winding operation can proceed without interruption.

The above described splicing machine is not completely satisfactory however, since the manual placement of the leading end of the new web in the machine presents a safety hazard, and since an accurate alignment of the leading end with the trailing end is not assured.

Several other types of butt splicing machines have been proposed for use in association with tube winding machines of the type as described above. The butt splicer disclosed in U.S. Pat. No. 4,769,098 is representative of these prior splicers, and it comprises a new web preparation assembly which is used to prepare the leading edge of a new web, a new web and tape holding assembly used to hold a portion of the new web and a strip of adhesive tape in preparation for splicing, a nip assembly used to clamp the expiring web, and a cutting and adhering assembly that simultaneously cuts the expiring web and causes the trailing end of the expiring web to be adhered to the leading edge of the new web.

While the apparatus described in the referenced patent is no doubt satisfactory for many production processes, it is believed that the apparatus would not be able to reliably cut and splice a damaged, wrinkled, or creased paper web.

It is accordingly an object of the present invention to provide an improved splicing apparatus which is able to reliably cut and splice webs of paper as they are sequentially fed to a tube winding machine or the like, and which may be safely operated.

It is also an object of the present invention to provide an improved butt splicing apparatus and method which results in the formation of a splice having adequate strength to pass through the remainder of the manufacturing process and to maintain its integrity in the final product.

It is a further object of the present invention to provide a butt splicing apparatus and method which maintains precise lateral alignment of the web segments to allow their passage through the remainder of the manufacturing process without degradation.

It is another object of the present invention to provide a butt splicing apparatus and method which is able to achieve a minimal spacing between the trailing end of the expiring web and the leading end of the new web to allow it to pass through the remainder of the manufacturing process without degradation and to maintain the integrity of the final product.

It is a more particular object of the present invention to provide a butt splicing apparatus and method which provides a clean cut and square edge for both the trailing end of the expiring web and the leading end of the new web and which invariably places the two ends at a consistent reference location on the splicer so that they may be pre-aligned and precisely joined.

SUMMARY OF THE INVENTION

The above and other objects and advantages of the present invention are achieved by the provision of a splicing apparatus and method which comprises a support plate having a generally flat upper surface for supporting a web of material thereon as it is advanced along a path of travel. A clamping device is provided to selectively clamp the advancing web of material onto the upper surface of the support plate to stop the advance thereof, and a web severing mechanism is mounted to the frame for transverse movement across the upper surface of the support plate to transversely sever the stopped web of material and thereby form a trailing end. A new web holding assembly releasably supports a leading end portion of a new web of material thereon, with the leading end portion of the new web of material including a leading end which is located in a predetermined initial position with respect to the assembly. The new web holding assembly is mounted for movement between a raised position wherein the leading end of the new web of material is in spaced relation above the trailing end of the stopped web, and a lowered position wherein the new web rests on the upper surface of the support plate and is linearly aligned with the stopped web. When so positioned, the trailing and leading ends of the webs may be interconnected by means of an interconnecting tape or the like.

In the preferred embodiment, the support plate includes a transverse slot along which the web severing mechanism is adapted to move, and the web severing mechanism includes a clamping wheel positioned to roll across and press the stopped web onto the upper surface of the support plate along the slot and thereby smooth and hold the portion of the stopped web adjacent the trailing end thereof. A separate cutting wheel is positioned to sever the stopped web as the web severing mechanism moves thereacross.

The apparatus of the invention preferably also includes a hand-held positioning tool for temporarily supporting the leading end portion of the new web in a predetermined orientation with respect to the tool, and the tool is adapted to be supported at a predetermined location on the frame of the apparatus wherein the leading end of the new web is in the predetermined initial position with respect to said new web holding assembly. Thus, by using the tool, the new web may be accurately loaded onto the new web holding assembly.

BRIEF DESCRIPTION OF THE DRAWINGS

Some of the objects and advantages of the present invention having been stated, others will appear as the description proceeds, when considered in conjunction with the accompanying drawings in which.

BRIEF DESCRIPTION OF THE PREFERRED EMBODIMENT

Figure 1:
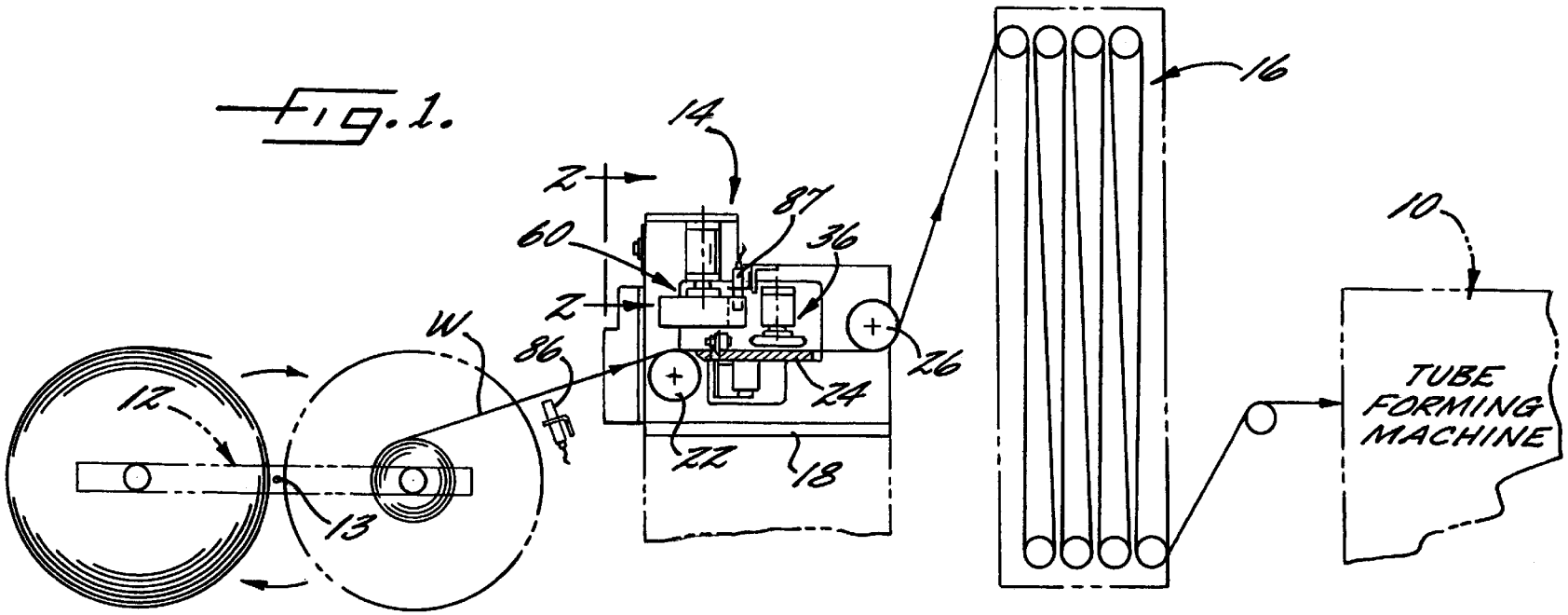
FIG. 1 is a somewhat schematic side elevation view of a butt splicing apparatus positioned in the web delivery path leading to a tube forming machine, and which embodies the features of the present invention.

Referring more particularly to the drawings, FIG. 1 schematically illustrates the components of a system for the continuous delivery of a web of paper w to a tube forming machine 10. The system includes a turret type delivery creel 12 having two roll supporting stands and which is rotatable about a horizontal axis 13 so that the two supporting positions can be reversed by rotation of the creel about the axis 13. As illustrated, the inboard stand supports the roll of the web being delivered to the tube forming machine, and the outboard stand supports a full roll in a standby position.

From the inboard stand on the creel, the web W is delivered to a web splicing apparatus 14 which embodies the present invention, and the web then continues to a festoon type accumulator 16 of conventional design and finally to the tube forming machine 10.

Figure 8:
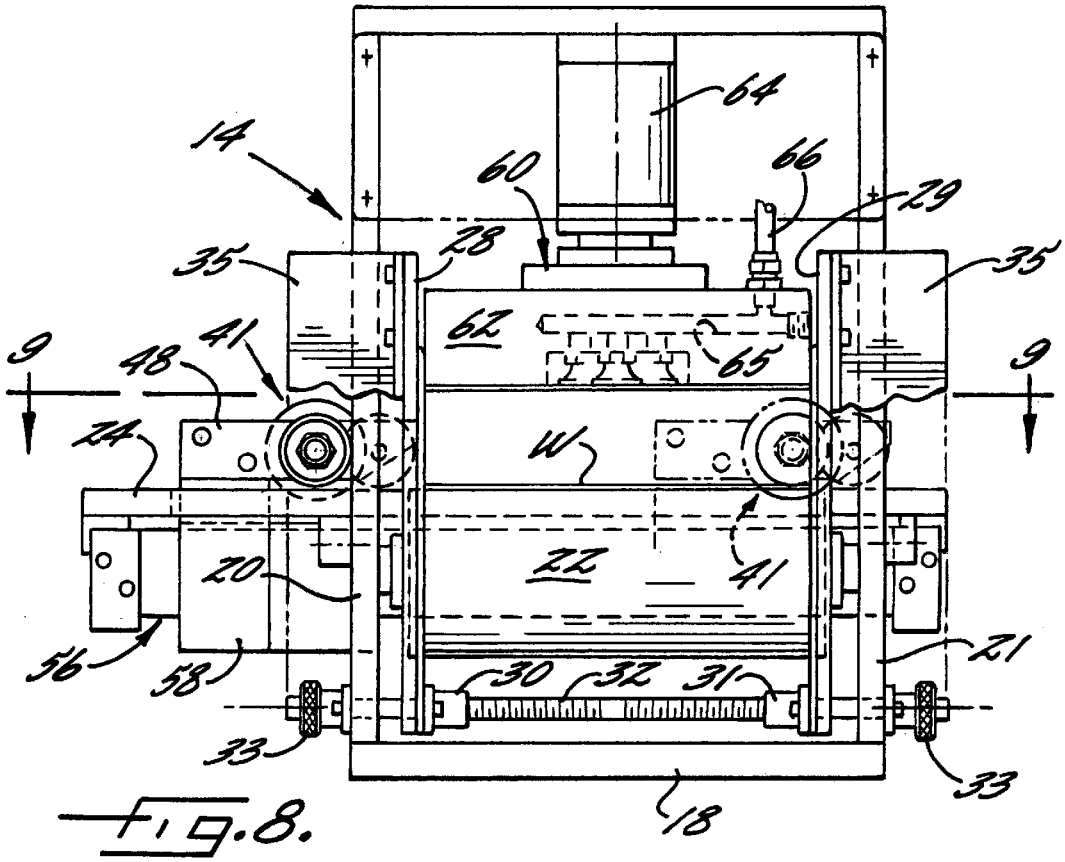
FIG. 8 is a partly sectioned front elevation view taken substantially along the line 8—8 of FIG. 6.

In the illustrated embodiment, the splicing apparatus 14 includes a generally box-like open frame which includes a base plate 18 and two upright side plates 20, 21, note FIG. 8. An upstream web guide roller 22 is mounted to extend horizontally between the side plates, and a horizontal web support plate 24 is mounted between the side plates, with the substantially flat upper surface 25 of the support plate 24 being horizontally aligned with the uppermost peripheral edge of the roller 22, note FIG. 6.

A downstream web guide roller 26 is also mounted between the side plates 20, 21, for guiding the web as it leaves the splicing apparatus and advances to the accumulator 16.

Figure 7:
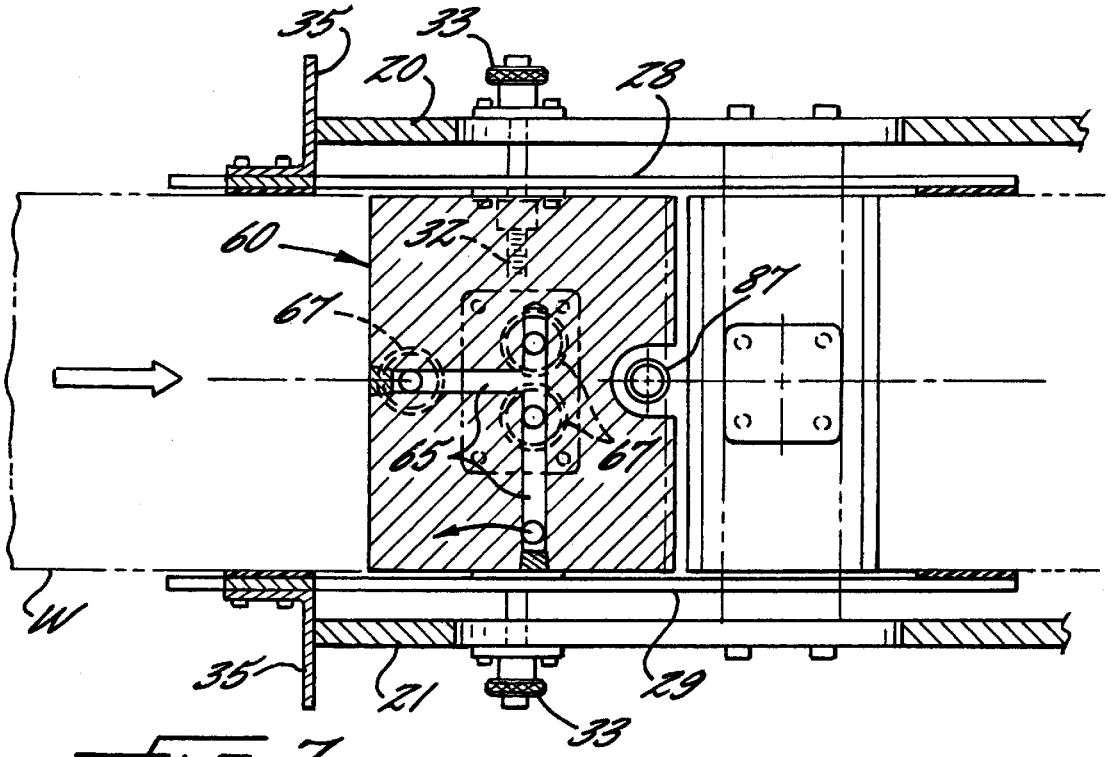
FIG. 7 is a sectioned plan view taken substantially along the line 7—7 of FIG. 6.

To guide advancing webs of different widths through the apparatus 14, there are provided two upright guide plates 28, 29 which are parallel to and adjacent respective ones of the side plates 20, 21, with the guide plates 28, 29 being mounted to carrier brackets 30, 31 which are in turn supported by a common threaded rod 32 which extends transversely between the side plates, note FIG. 8. The threaded rod 32 includes oppositely threaded sections which mount respective ones of the carrier brackets 30, 31, and a control knob 33 is provided at each end of the rod 32 to permit the rod to be rotated and thereby adjust the spacing between the side plates 20, 21. The upstream edges of the side plates each mount on angled upright bracket 35 for the purpose described below, note FIG. 7.

Figure 6:
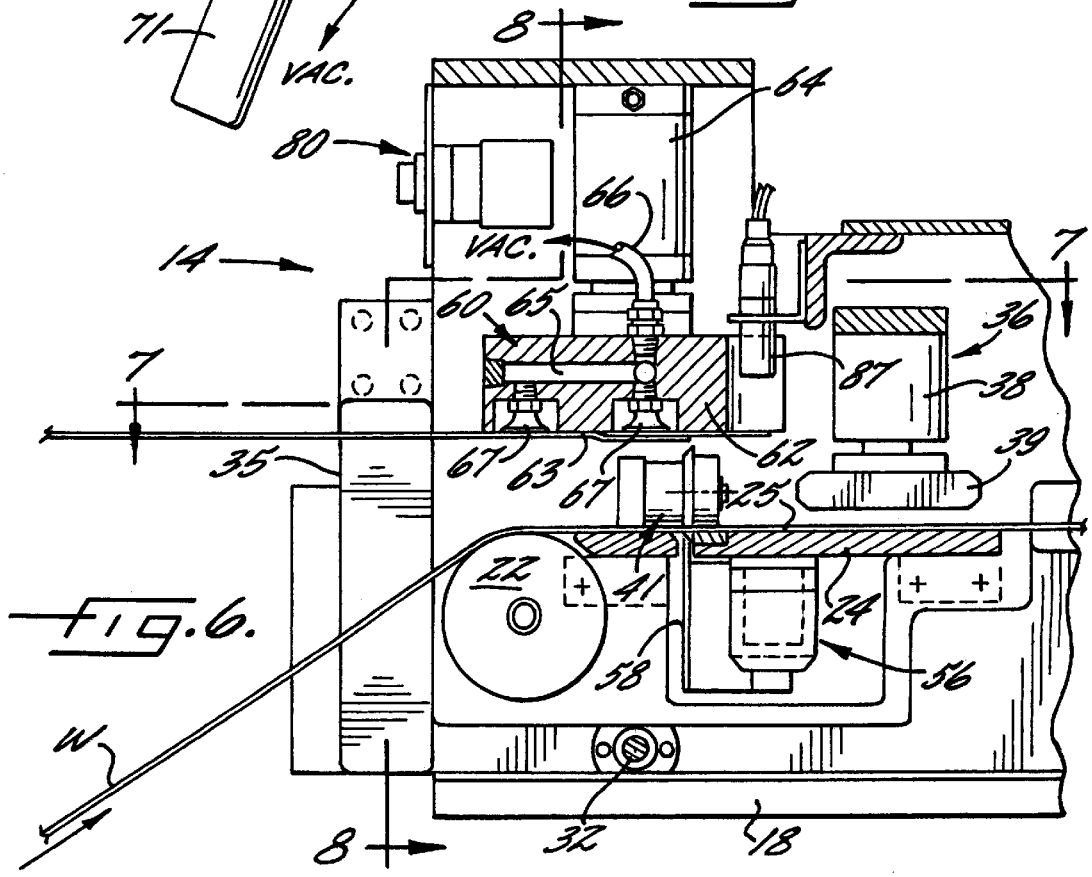
FIG. 6 is a fragmentary partly sectioned side elevation view of the rear portion of the butt splicing apparatus shown at a point in time in the splicing sequence subsequent to that of FIG. 3.
Figure 11:
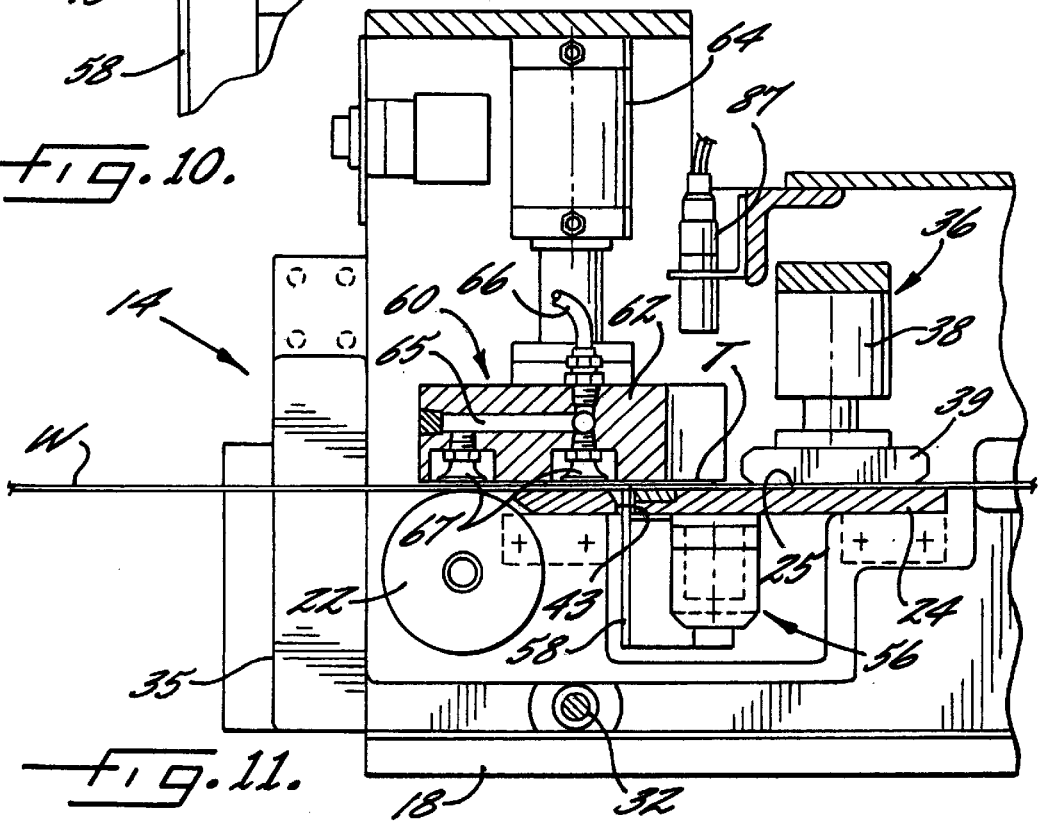
FIG. 11 is a view similar to view 6 and illustrating the apparatus at a subsequent point in time in the splicing operation.

As best seen in FIGS. 6 and 11, the apparatus includes a clamping device 36 mounted on the frame to selectively clamp the advancing web of material W onto the upper surface 25 of the support plate 24 to stop the advance thereof. The clamping device 36 includes a pneumatic cylinder 38 having a pad 39 positioned on the lower end of its output shaft, so that the pad 39 may be selectively raised (FIG. 6) or lowered (FIG. 11).

Figure 9:
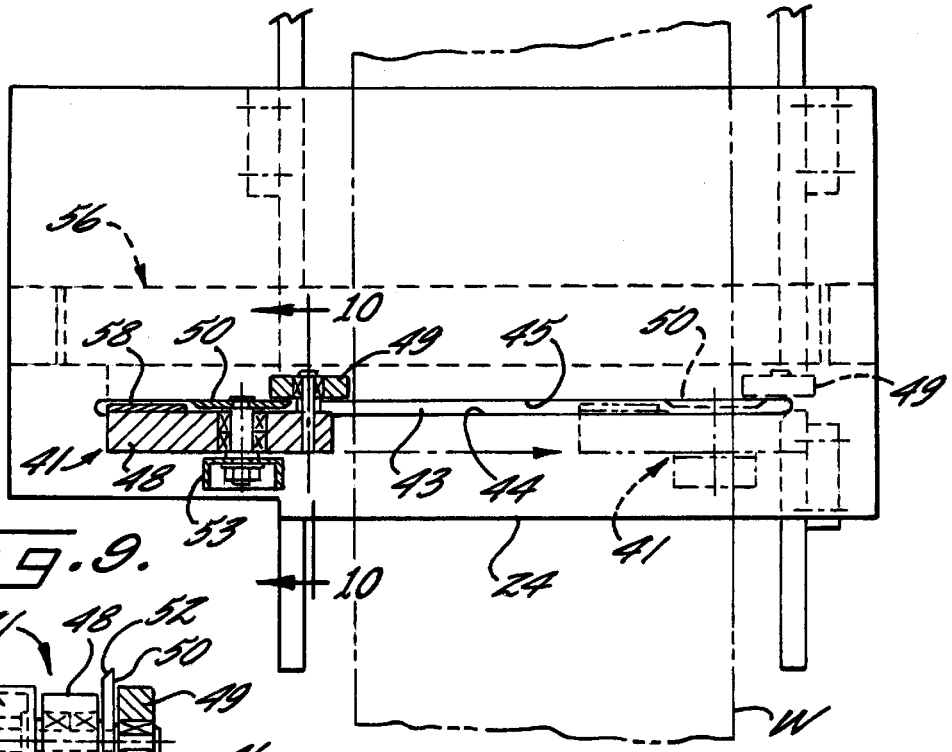
FIG. 9 is a sectioned plan view taken substantially along the line 9—9 of FIG. 8.
Figure 10:
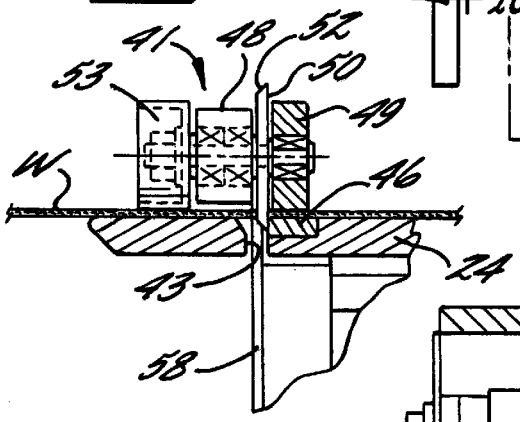
FIG. 10 is a fragmentary sectioned view illustrating the web severing mechanism and the bracket plate for interconnecting the mechanism to its drive cylinder.

As best seen in FIGS. 9 and 10, the apparatus further includes a web severing mechanism 41 mounted to the frame for transverse movement across the upper surface 25 of the support plate 24 to transversely sever the stopped web of material and thereby form a trailing end of the web. The support plate 24 includes a transverse slot 43 along which the web severing mechanism 41 is adapted to move, and the slot 43 defines an upstream transverse edge 44 and a downstream transverse edge 45, which are parallel to each other and spaced apart a distance of about one-quarter inch. The downstream transverse edge 45 is perpendicular to the upper surface 25 of the support plate, and it is defined in part by a tool steel inlay 46 as best seen in FIG. 10.

The web severing mechanism 41 includes a carrier plate 48 which rotatably mounts a clamping wheel 49 on one side thereof and which is positioned to roll across and press the stopped web onto the support plate 24 along the slot 43 and thereby smooth the portion of the stopped web adjacent the trailing end of the severed web. Also, the carrier plate 48 rotatably mounts a cutting wheel 50 positioned to sever the stopped web as the web severing mechanism 41 moves thereacross. The cutting wheel 50 has an annular cutting edge 52 which projects into the slot 43, and the annular cutting edge 52 is defined by a single bevel on the outer periphery of the cutting wheel so that the annular cutting edge 52 engages the downstream transverse edge 45 of the slot. The tool steel inlay 46 forms the operative surface against which the cutting wheel 50 engages, so as to prevent undue wear from the contact between the transverse edge 46 and the cutting wheel.

The cutting wheel 50 is positioned on the carrier plate 48 so as to be transversely spaced from the clamping wheel 49, and behind the clamping wheel as the severing mechanism 41 moves across the web, i.e., from the solid line position to the dashed line position as seen in FIGS. 8 and 9. Also, the web severing mechanism 41 further includes a drive wheel 53 which is coaxially and rotatably connected to the cutting wheel 50 and which is positioned on the side of the carrier plate 48 opposite that of the clamping wheel 49 and the cutting wheel 50. Thus as the severing mechanism 41 moves along the slot 43 to sever the web, the drive wheel 53 will roll across that portion of the trailing edge portion of the web which is on the upstream side of the slot 43, to thereby rotate the cutting wheel 50.

A drive cylinder 56 is provided for reciprocating the web severing mechanism 41 transversely across the upper surface 25 of the support plate 24, and is mounted below the support plate as best seen in FIG. 11. Also, a bracket plate 58 extends through the slot 43 and interconnects the drive cylinder 56 and the carrier plate 48 of the web severing mechanism 41.

The drive cylinder 56 is a rodless, pneumatic cylinder of conventional design, and the piston (not shown) which is inside the cylinder 56 is connected to the bracket plate 58 on the outside of the cylinder so that the bracket plate moves along the slot as the piston reciprocates within the cylinder. There is a sealing mechanism (not shown) that maintains pressure in the cylinder as the piston moves.

A new web holding assembly 60 is provided for releasably supporting the leading end portion of a new web of material thereon, with the leading end of the new web being located in a predetermined initial position with respect to the assembly 60 and the underlying slot 43. More particularly, the web holding assembly 60 includes a support platen 62 having a generally flat lower surface 63, and which is mounted to a pneumatic drive cylinder 64 so as to be moveable between a raised position (FIG. 6) and a lowered position (FIG. 11). The platen 62 includes an internal air line system 65 which is connected to a vacuum source via a line 66 and which communicates with a plurality of downwardly open vacuum cups 67.

Figure 4:
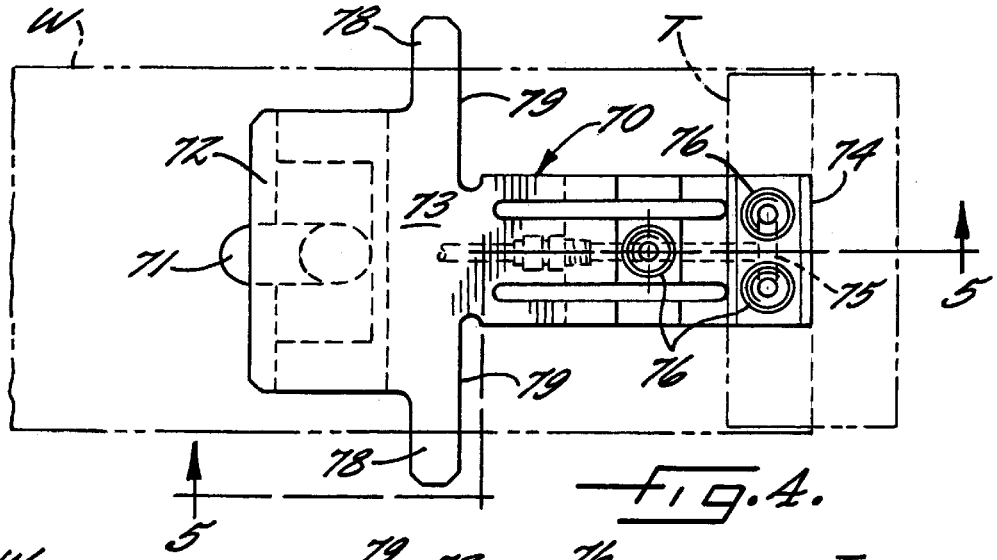
FIGS. 4 and 5 are top plan and partially sectioned side elevation views of the tool shown in FIG. 3.
Figure 5:
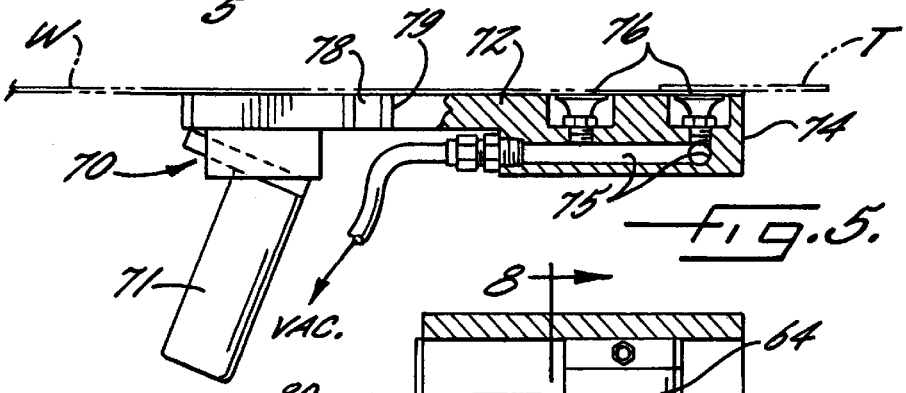

The apparatus of the present invention further comprises a hand-held positioning tool 70 for temporarily supporting the leading end portion of the new web in a predetermined orientation with respect to the tool. As best seen in FIGS. 4 and 5, the tool 70 includes a handle grip 71 which is connected to an upper plate 72 which defines a flat upper surface 73 upon which the leading end portion of the new web is initially placed. The tool 70 also includes a transverse forward reference edge 74 which is adapted to be aligned with the leading end of the new web when the web is manually placed on the upper surface 72. The tool 70 further has an internal vacuum chamber 75 which communicates with a vacuum source and with a plurality of upwardly facing vacuum cups 76 which act to firmly hold the web W on the upper surface.

Figure 3:
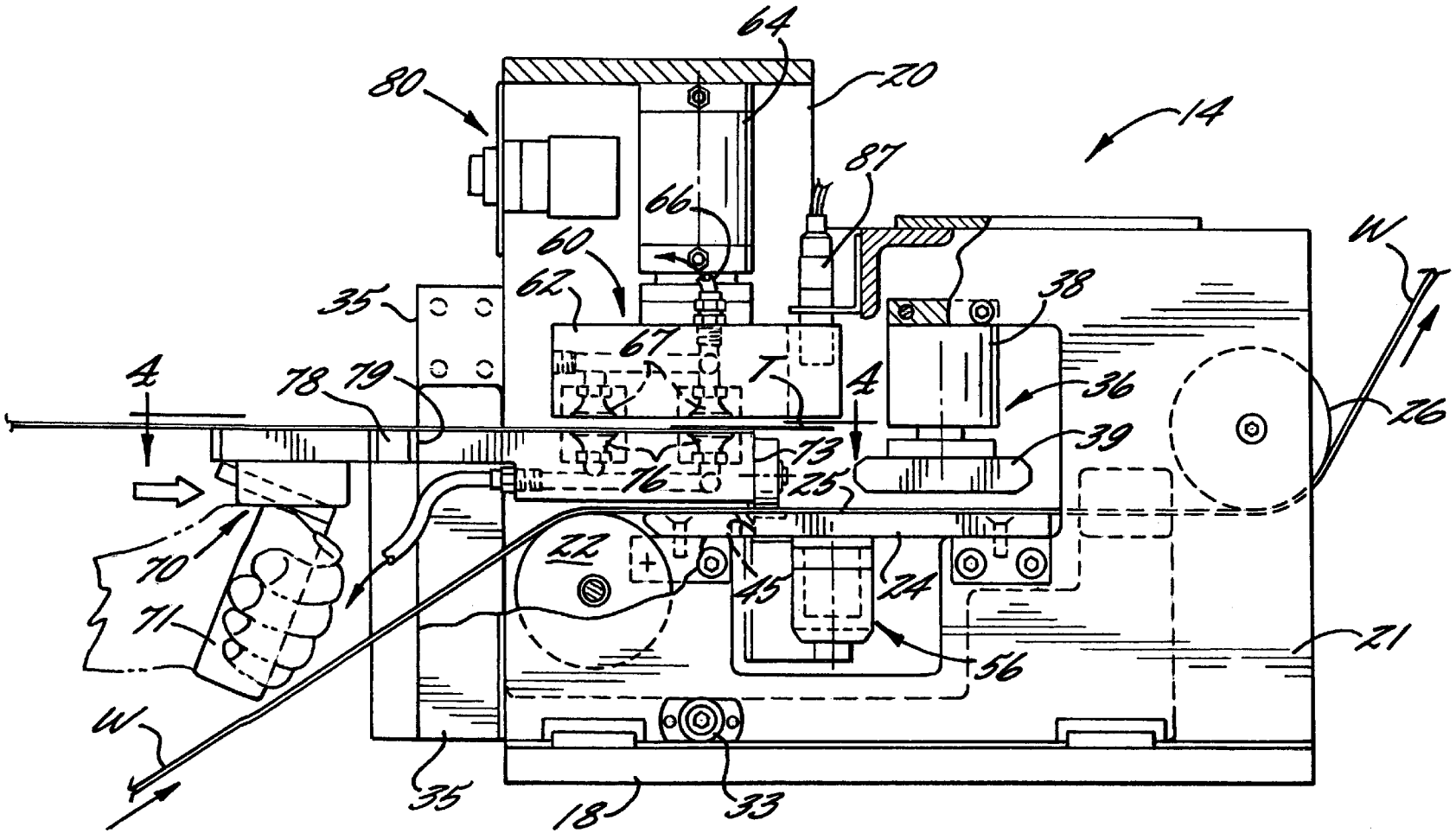
FIG. 3 is a partly sectioned side elevation view of the butt splicing apparatus of FIG. 1, and illustrating the hand-held positioning tool for temporarily supporting the leading end of the new web in a predetermined orientation with respect to the tool, and wherein the tool is releasably supported at a predetermined location in the machine.

The rear portion of the upper plate 72 of the tool 70 includes transverse arms 78 which define an engaging surface 79 for accurately locating the tool when it is inserted into the splicing apparatus in the manner illustrated in FIG. 3. More particularly, the tool 70 is adapted to be positioned so that it rests directly beneath the support platen 62 of the new web holding assembly 60, and so that the engaging surfaces 79 contact the upright brackets 35. When the tool 70 is so positioned, the leading end of the new web is in a predetermined initial position with respect to the new web holding assembly 60, i.e., the leading end is aligned directly above the downstream transverse edge 45 of the slot 43. As further explained below, the release of the vacuum in the tool 70 and the activation of the vacuum in the support platen 62 causes the forward end portion of the new web to be released from the tool 70 and held by the support platen 62, so that the tool can then be removed from the splicing apparatus.

Figure 2:
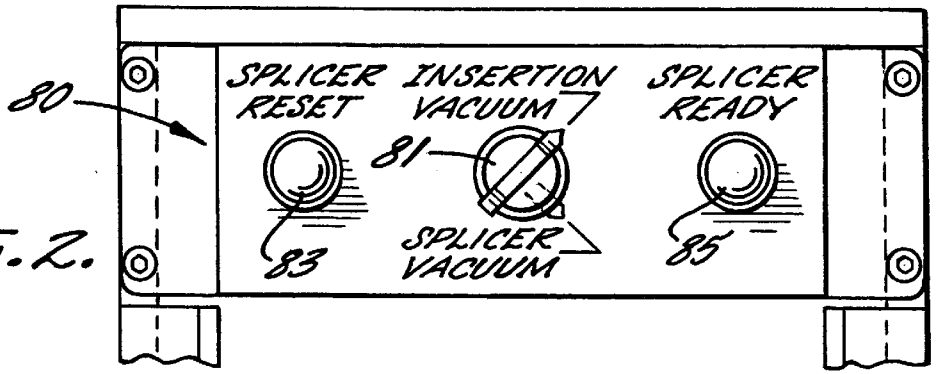
FIG. 2 is a fragmentary front elevation view of the control panel of the apparatus and taken substantially along the line 2—2 of FIG. 1.

To permit the operator to control the operation of the splicing apparatus, the front control panel (FIG. 2) includes a vacuum switch 81 for controlling the vacuum to either the tool 70 or the support platen 62. The panel also includes a splicer reset button 83 which deactivates the vacuum generator. Thus if the new web gets incorrectly positioned, the operator can press the reset button and start again. A splicer ready button 85 is also provided as a safety feature, and which serves as an arming button which is connected to the programmed logic control so as to preclude operation of the splicing apparatus until it is pushed. Also, an upstream optical sensor 86 is provided for monitoring for the expiration of the web W being delivered from the inboard stand of the creel 12, and a second optical sensor 87 is provided for monitoring for the presence of a new web on the support platen.

The Splicing Process

When ready to prepare for a splice, the operator positions a new roll of paper in the outboard stand of the creel 12, and the end of the new roll is cut by conventional paper cutting equipment (not shown) to form a clean and square cut. The leading end of the new roll is then positioned on the positioning tool 70, with the leading end aligned with the forward reference edge 74 of the tool. When the end of the new roll is in the proper position on the tool 70, the vacuum is energized on the tool, and a single sided adhesive tape T is applied to the end of the new roll so as to extend forwardly from the end of the web, note FIG. 5. The positioning tool and the end of the new roll are then inserted into the splicer and positioned using the reference surfaces built into the splicer and the positioning tool by the engaging surfaces 79 and the upright brackets 51. When the end of the new roll is properly positioned, the vacuum in the positioning tool is deenergized and the vacuum system of the support platen is immediately activated by rotation of the switch 81. The positioning tool is then withdrawn and placed in a holder until needed for the next loading cycle.

Depressing the ready button 85 arms the splicer via a programmed logic control, and when the active roll expires and the optical sensor 86 no longer detects the presence of the expiring web, the automatic splicing sequence begins. More particularly, the air cylinder 38 extends and brings the pad 39 down to clamp the tail of the expiring web and thereby stop the advance of the expiring web. It will be noted however that the tube forming machine 10 is able to continue to run, using material from the festoon accumulator 16. The second optical sensor 87, which senses the presence of the end of the new web beneath it, is connected to the programmed logic control so as to prevent the arming of the circuit if the new web is not present, even though the ready button 85 has been pressed.

The air cylinder 56 then extends, moving the web severing mechanism 41 across the end of the stopped expiring web so as to form a square cut. As part of this operation, the clamping wheel 49 is positioned to roll across and press the stopped web onto the upper surface 25 of the support plate 24 along the slot 43 and thereby smooth and clamp the portion of the stopped web adjacent the trailing end thereof. Also, the cutting wheel 50 is positioned to sever the stopped web, and it is rotated by the drive wheel 53 which rolls across the web on the opposite side of the slot as the web severing mechanism advances across the web, to thereby increase the cutting reliability of the cutting wheel.

The fact that the cutting wheel 50 is single beveled, and positively rotated, provides a clean cut and a square edge, and serves to invariably place the trailing end at a consistent reference location. Also, the clamping wheel 49 assures reliable cutting of damaged, wrinkled, or creased paper in that it clamps and smoothes the paper sufficiently for reliable cutting.

After the cutting cycle is complete, the air cylinder 64 is activated so as to move the support platen 62 down until the upstream end of the new roll is attached to the downstream end of the expiring roll. This is accomplished by pressing the exposed portion of the adhesive tape T into contact with the severed end portion of the expiring web and against the upper surface 25 of the plate 24. The support platen 62 and the pad 39 then retract, and the downstream tube forming process pulling on the web restarts the advance of the web. The roll delivery creel 12 then rotates about its axis 13 to reverse the positions of the inboard and outboard stands, and the splicing cycle is complete when the festoons return to their fully extended position in the accumulator 16. The severed end portion of the expiring web is then removed by gravity or by hand.

Many modifications and other embodiments of the invention will come to mind to one skilled in the art to which this invention pertains having the benefit of the teachings presented in the foregoing descriptions and the associated drawings. For example, while the above apparatus and process is uniquely designed to form a butt splice as described, it will be understood that an overlapping splice may be formed by forwardly extending the predetermined initial position of the leading end of the new web, and utilizing a double sided tape. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for forming a splice between the trailing end of an expiring web of material which is advanced along a path of travel, and the leading end of a new web of material, and comprising a frame including a support plate having a generally flat upper surface for supporting a web of material thereon as it is advanced along the path of travel, clamp means mounted on the frame to selectively clamp the advancing web of material onto the upper surface of the support plate to stop the advance thereof, a web severing mechanism mounted to the frame for transverse movement across the upper surface of the support plate to transversely sever the stopped web of material and thereby form a trailing end, said web severing mechanism including a cutting wheel positioned to sever the stopped web, and a drive wheel coaxially and rotatably connected to said cutting wheel and positioned to roll across the portion of the stopped web of material resting upon the upper surface of said support plate as the web severing mechanism moves transversely across the support plate to thereby rotate the cutting wheel, a drive for reciprocating the web severing mechanism transversely across the upper surface of the support plate, and which includes a drive cylinder mounted below said support plate and a bracket plate extending through a transverse slot in the support plate along which the web severing mechanism is adapted to move, with the bracket plate interconnecting said drive cylinder and said web severing mechanism, a new web holding assembly for releasably supporting a leading end portion of a new web of material thereon, with the leading end portion of the new web of material including a leading end which is located in a predetermined initial position with respect to the assembly, means mounting the new web holding assembly on the frame for movement between a raised position wherein the leading end of the new web of material is in spaced relation above the trailing end of the stopped web, and a lowered position wherein the new web rests on the upper surface of the support plate and is linearly aligned with the stopped web, drive means for selectively moving the new web holding assembly between the raised and lowered positions, whereby the trailing and leading ends of the webs may be interconnected by means of an interconnecting member when the new web holding assembly is moved to said lowered position.

2. The apparatus as defined in claim 1 wherein said web severing mechanism further comprises a clamping wheel positioned to roll across and press the stopped web onto the upper surface of the support plate along the transverse slot and thereby smooth the portion of the stopped web adjacent the trailing end thereof.

3. The apparatus as defined in claim 2 wherein the cutting wheel has an annular cutting edge which projects into said slot.

4. The apparatus as defined in claim 3 wherein said slot defines a transverse edge which is perpendicular to the upper surface of the support plate, and wherein said annular cutting edge of said cutting wheel is defined by a single bevel on the outer periphery of the cutting wheel which engages said transverse edge of said slot.

5. The apparatus as defined in claim 3 wherein said cutting wheel is positioned so as to be transversely spaced from said clamping wheel, and wherein said clamping wheel is positioned to roll across the trailing end of the stopped web of material.

6. The apparatus as defined in claim 1 further comprising a tool for temporarily supporting the leading end portion of the new web in a predetermined orientation with respect to the tool, and means on the frame of the apparatus for releasably supporting the tool at a predetermined location wherein the leading end of the new web is in said predetermined initial position with respect to said new web holding assembly.

7. The apparatus as defined in claim 1 wherein in the lowered position of the new web holding assembly the leading end of the new web abuts the trailing end of the stopped web.

8. An apparatus for forming a splice between the trailing end of an expiring web of material which is advanced along a path of travel, and the leading end of a new web of material, and comprising a frame including a support plate having a generally flat upper surface for supporting a web of material thereon as it is advanced along the path of travel, clamp means mounted on the frame to selectively clamp the advancing web of material onto the upper surface of the support plate to stop the advance thereof, a web severing mechanism mounted to the frame for transverse movement across the upper surface of the support plate to transversely sever the stopped web of material and thereby form a trailing end, a new web holding assembly for releasably supporting a leading end portion of a new web of material thereon, with the leading end portion of the new web of material including a leading end which is located in a predetermined initial position with respect to the assembly, a tool for temporarily supporting the leading end portion of the new web in a predetermined orientation with respect to the tool, and means on the frame of the apparatus for releasably supporting the tool at a predetermined location wherein the leading end of the new web is in said predetermined initial position with respect to said new web holding assembly, means mounting the new web holding assembly on the frame for movement between a raised position wherein the leading end of the new web of material is in spaced relation above the trailing end of the stopped web, and a lowered position wherein the new web rests on the upper surface of the support plate and is linearly aligned with the stopped web, drive means for selectively moving the new web holding assembly between the raised and lowered positions, whereby the trailing and leading ends of the webs may be interconnected by means of an interconnecting tape or the like when the new web holding assembly is moved to said lowered position.

9. The apparatus as defined in claim 8 further comprising a vacuum system for selectively holding the leading end portion of the new web in the predetermined orientation on the tool, and holding the leading end portion of the new web on the new web holding assembly with the leading end thereof located in said predetermined initial position.

10. The apparatus as defined in claim 9 further comprising a drive for reciprocating the web severing mechanism transversely across the upper surface of the support plate, and which includes a drive cylinder and a bracket plate interconnecting said drive cylinder and said web severing mechanism.

11. A method of forming a splice joining an expiring web of material which is advancing along a path of travel with the leading end of a new web of material, and comprising the steps of advancing a web of material of finite length along a path of travel, stopping the advance of the web of material when the trailing end thereof approaches a splicing location, transversely severing the stopped web of material at the splicing location to thereby form a trailing severed end of the stopped web, and including advancing a web severing mechanism transversely across the stopped web, said web severing mechanism comprising a clamping member positioned to move across and smooth the expiring web, and a cutting wheel positioned to sever the smoothed web as the web severing mechanism advances across the web, and while positively rotating the cutting wheel so that the cutting wheel rolls across the expiring web during the severing step, and positioning the leading end of a new web of material in an aligned position wherein the leading end is in linear alignment with the trailing end of the stopped web, and then joining the two ends together, the positioning step including placing the leading end portion of the new web in a predetermined orientation on a moveable separate tool, moving the tool into a predetermined location wherein the leading end of the new web is in a predetermined initial position aligned in spaced relation above the trailing end of the expiring web, withdrawing the tool while retaining the leading end of the new web in said predetermined initial position, and lowering the leading end portion of the new web to said aligned position.

12. The method as defined in claim 11 wherein the clamping member is a clamping wheel, and wherein the cutting wheel is positioned to follow behind the clamping wheel during the severing step.

13. The method as defined in claim 11 wherein the cutting wheel is positively rotated by means of a drive wheel which is coaxially and rotatably connected to said cutting wheel and positioned to roll across the stopped web of material during the severing step.

14. The method as defined in claim 11 wherein in said aligned position, the leading end of the new web abuts the trailing end of the stopped web.

15. A method of forming a splice joining an expiring web of material which is advancing along a path of travel with the leading end of a new web of material, and comprising the steps of advancing a web of material of finite length along a path of travel, stopping the advance of the web of material when the trailing end thereof approaches a splicing location, transversely severing the stopped web of material at the splicing location to thereby form a trailing end of the stopped web, and positioning the leading end of a new web of material in an aligned position wherein the leading end is in linear alignment with the trailing end of the stopped web, and including placing the leading end portion of the new web in a predetermined orientation on a moveable separate tool, moving the tool into a predetermined location wherein the leading end of the new web is in a predetermined initial position aligned in spaced relation above the trailing end of the expiring web, withdrawing the tool while retaining the leading end of the new web in said predetermined initial position, and lowering the leading end portion of the new web to said aligned position, and then joining the two ends together.

16. An apparatus for forming a splice between the trailing end of an expiring web of material which is advanced along a path of travel, and the leading end of a new web of material, and comprising a frame including a support plate having a generally flat upper surface for supporting a web of material thereon as it is advanced along the path of travel, clamp means mounted on the frame to selectively clamp the advancing web of material onto the upper surface of the support plate to stop the advance thereof, a web severing mechanism mounted to the frame for transverse movement across the upper surface of the support plate to transversely sever the stopped web of material and thereby form a trailing end, said web severing mechanism including a cutting member positioned to sever the stopped web, and a separate pressing member positioned to press the stopped web on the upper surface of the support plate as the web severing mechanism moves across the upper surface of the support plate, a new web holding assembly for releasably supporting a leading end portion of a new web of material thereon, with the leading end portion of the new web of material including a leading end which is located in a predetermined initial position with respect to the assembly, means mounting the new web holding assembly on the frame for movement between a raised position wherein the leading end of the new web of material is in spaced relation above the trailing end of the stopped web, and a lowered position wherein the new web rests on the upper surface of the support plate and is linearly aligned with the stopped web, drive means for selectively moving the new web holding assembly between the raised and lowered positions, and a tool for temporarily supporting the leading end portion of the new web in a predetermined orientation with respect to the tool, and means on the frame of the apparatus for releasably supporting the tool at a predetermined location wherein the leading end of the new web is in said predetermined initial position with respect to said new web holding assembly, whereby the trailing and leading ends of the webs may be interconnected by means of an interconnecting tape when the new web holding assembly is moved to said lowered position.

* * * * *